US005478393A

United States Patent [19]

Vacanti

[11] Patent Number: 5,478,393

[45] Date of Patent: Dec. 26, 1995

[54] ICE PAINTING APPARATUS

[76] Inventor: William J. Vacanti, P.O. Box 401, Fredonia, N.Y. 14063-0401

[21] Appl. No.: 375,716

[22] Filed: Jan. 20, 1995

[51] Int. Cl.[6] ..... B05B 15/04

[52] U.S. Cl. ..... 118/323; 118/313; 118/315; 239/288

[58] Field of Search ..... 118/313, 305, 118/315, 323, 300, 108; 137/377, 379; 239/288, 288.3, 288.5, 525, 529, 569, 570, 750, 722

[56] References Cited

U.S. PATENT DOCUMENTS

| | | | |
|---|---|---|---|
| Re, 24,008 | 5/1955 | Mosher | 239/150 |
| 1,709,091 | 4/1929 | Nissly | 401/45 |
| 2,367,594 | 1/1945 | Madison | 118/301 |
| 2,500,660 | 3/1950 | Chappen | 118/305 |
| 2,555,826 | 6/1951 | Tallman | 239/104 |
| 2,812,211 | 11/1957 | Gardner | 239/150 |
| 3,240,184 | 3/1966 | Le Mieux et al. | 118/108 |
| 3,512,714 | 5/1970 | Phelps et al. | 239/168 |
| 3,609,631 | 9/1971 | Looney | 439/100 |
| 3,990,800 | 11/1976 | Graff | 401/219 |
| 4,192,462 | 3/1980 | Erickson | 239/288 |
| 4,345,544 | 8/1982 | Besecker | 118/108 |
| 4,895,306 | 1/1990 | Whitehurst, Jr. | 239/288 |
| 4,975,075 | 12/1990 | Jinno et al. | 439/353 |
| 5,029,758 | 7/1991 | Chayer | 239/172 |
| 5,127,164 | 7/1992 | Belcourt et al. | 33/27.03 |
| 5,188,700 | 2/1993 | Gilkes | 156/575 |

FOREIGN PATENT DOCUMENTS

| | | |
|---|---|---|
| 545968 | 6/1942 | United Kingdom . |
| 2089688 | 6/1982 | United Kingdom . |

*Primary Examiner*—David L. Lacey
*Assistant Examiner*—Calvin Padgeti
*Attorney, Agent, or Firm*—Richard C. Litman

[57] ABSTRACT

An ice painting apparatus which paints all the necessary lines, circles and insignia used on an ice rink (e.g., for ice hockey). The device includes a series of guide mechanisms which allow spray shields of particular widths to follow predetermined patterns, including as straight lines or circles. The shields contain spray ports which are connected to a pressurized paint dispersal system. The system allows the necessary lines to be painted in an accurate and expeditious manner.

20 Claims, 7 Drawing Sheets

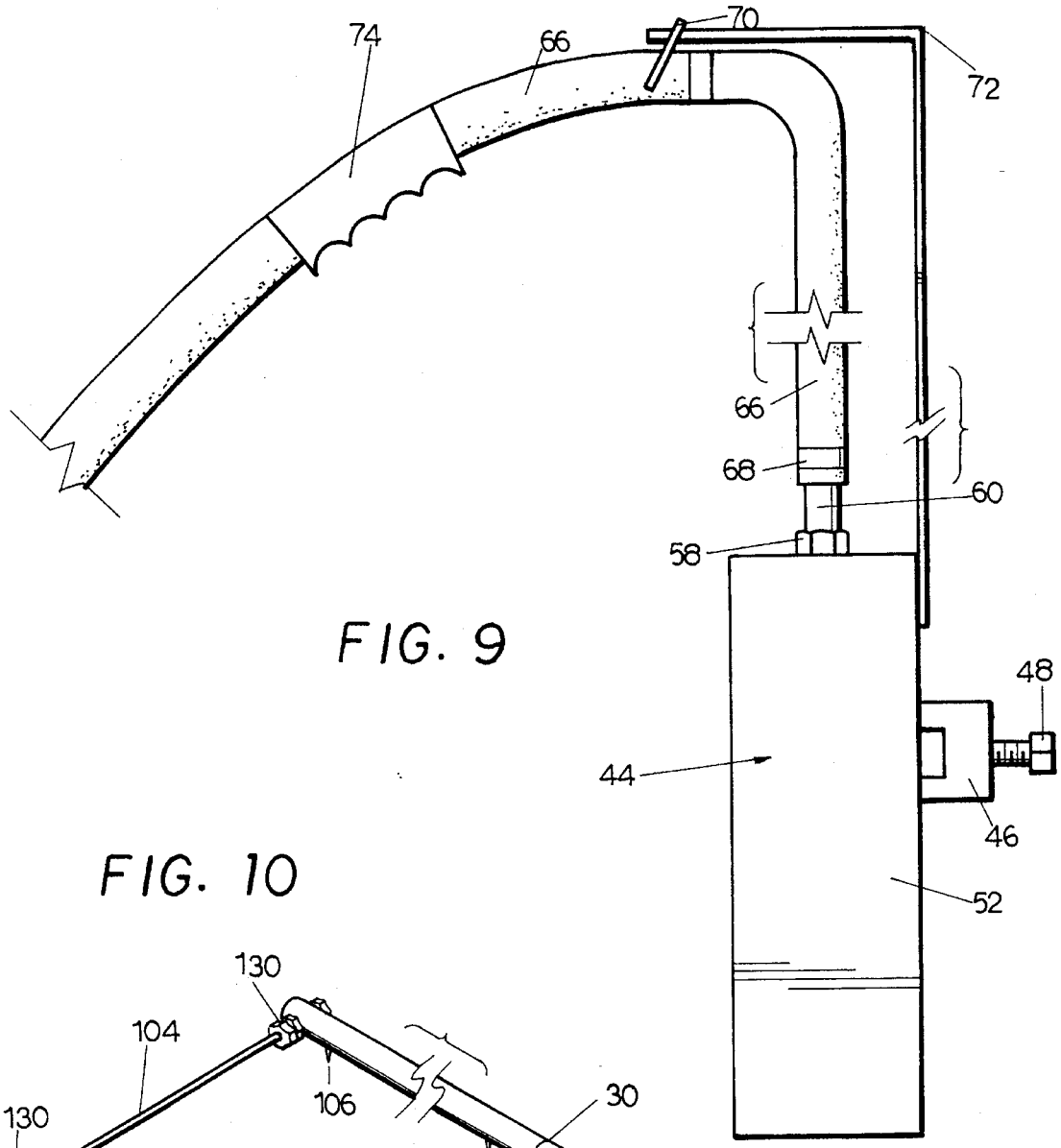
FIG. 9
FIG. 10
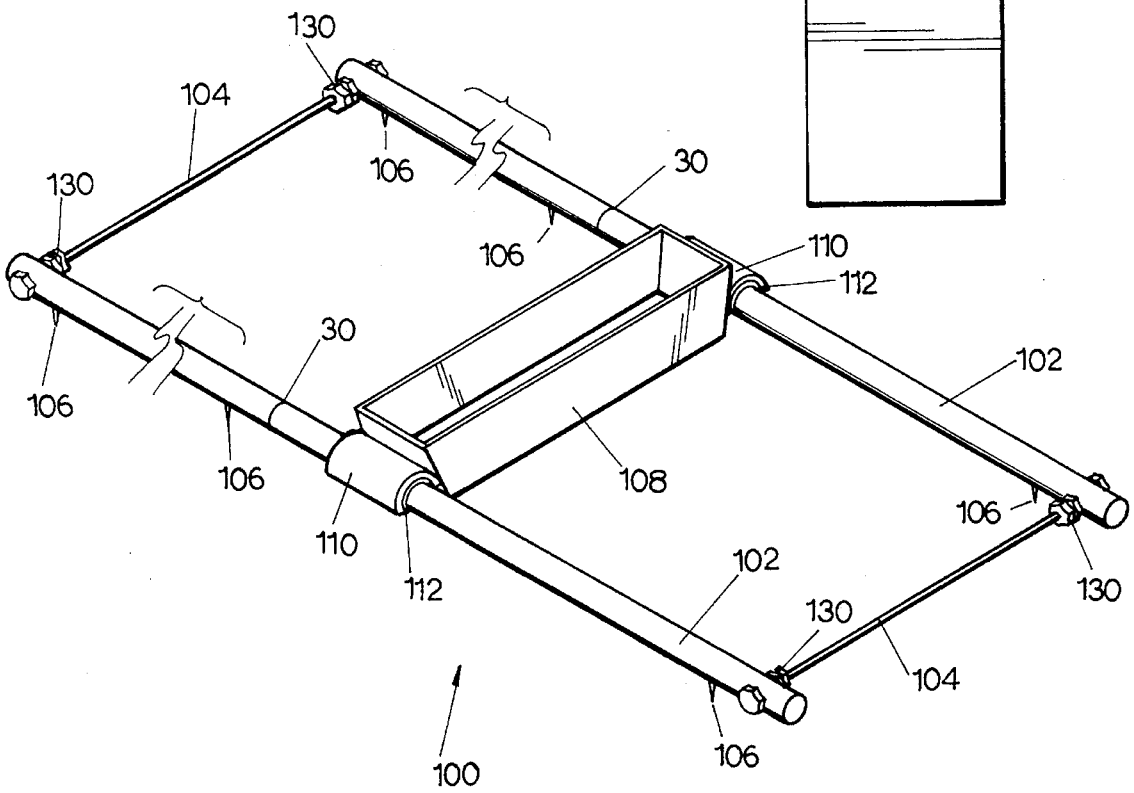

ICE PAINTING APPARATUS

BACKGROUND OF THE INVENTION

1. Field of the Invention

The present invention relates to ice painting devices.

2. Background of the Invention

Ice rinks which are used for the sport of hockey have an inherent burden in that they must maintain a specific pattern of lines and circles in the ice. Through the normal use of the rink, as well as the more abusive use during a hockey game, these lines will fade and eventually disappear. Therefore the lines must be reapplied at regular intervals. In the past this has meant scribing the area to be painted and then hand painting the area with a brush or a sponge. This method is extremely time consuming, wasteful, labor intensive and thus expensive. Improvements to this method have included using a rolling brush attached to a guiding apparatus. This presents the problem of the roller freezing and not rolling, and simply skidding along the ice. Further, this method uses more paint than is necessary. The next stage of ice marking involved laying strips of colored tape in the ice. This material is hard to work with, easily damaged and may leave remnants. Therefore it is desirable to have an apparatus which applies paint in a quick, efficient and uncomplicated manner.

DESCRIPTION OF THE PRIOR ART

U.S. Pat. No. Re. 24,008, reissued to E. Mosher on May 24, 1955, and U.S. Pat. No. 2,555,826, issued to H. M. Tallman on Jun. 5, 1951, disclose shields which attach to spray guns to limit the spray pattern being dispersed. While the '826 invention has a set of wheels to guide the shield, neither apparatus allows the shield itself to come into contact with the surface being coated, which will inevitably lead to some variance in the dispersal pattern as well as paint escaping beyond the intended limits of the shield. Furthermore, neither of these inventions addresses ice painting.

U.S. Pat. Nos. 1,709,091, issued to W. S. Nissly on Apr. 16, 1929, and 2,812,211, issued to C. L. Gardner on Nov. 5, 1957, present walk-behind devices having a paint dispersal means directed to a nozzle or nozzles oriented towards the ground. Each device has a shield, which is not in contact with the surface being painted. These carts, being on wheels, may lay any pattern desired; however, it would be difficult to accurately lay a pattern, other than a straight line, in a consistent manner. U. K. Pat. No. 545,968, issued to W. E. Ripper on Jun. 22, 1942, discloses a similar device wherein a trailer is equipped with a spraying mechanism to apply chemicals or other liquids to crops.

U.S. Pat. No. 2,367,594, issued to R. E. Madison on Jan. 16, 1945, shows a complicated bridging system designed to repeatedly spray a specified area. The device has a system of tracks and rails which allow a series of spray heads to be moved across a relatively large area. Again, ice painting is not considered in the Madison patent.

U.S. Pat. No. 3,990,800, issued to R. Graff on Nov. 9, 1976, shows a paint roller on an elongated handle, having an integrated paint supply and dispersing apparatus, specifically designed for applying paint to ice.

U.S. Pat. Nos. 5,127,164 issued to G. Belcourt et al. on Jul. 7, 1992, and 5,188,700, issued to R. R. Gilkes on Feb. 23, 1993, show devices for laying strips of paper onto a ice surface.

None of the above inventions and patents, taken either singly or in combination, is seen to describe the instant invention as claimed.

SUMMARY OF THE INVENTION

The present invention relates to an ice painting system capable of laying all the necessary lines, circles and insignia on an ice rink in a quick, simple and efficient manner Accordingly, it is an object of the invention to provide an ice painting apparatus having a spray shield which engages the surface of the ice on at least two sides of the shield in order to lay an accurate line without dragging the freshly laid paint.

It is an object of the invention to provide an ice painting apparatus having a distribution of spray ports, within the shield, configured in such a manner as to provide an even coating of paint without wasteful overspray.

Another object of the invention is to provide an ice painting apparatus having spray ports of a predetermined, correct tolerance to apply the relatively thin, water based paint that is used on ice.

It is another object of the invention to provide an ice painting apparatus having a pressurized control system to accurately and evenly distribute the paint to the spray ports.

It is a further object of the invention to provide an ice painting apparatus having a plurality of different sized shields in order to paint all the necessary and varying lines and insignia on an ice rink.

Still another object of the invention is to provide an ice painting apparatus having a set of adjustable guide rails which allow the apparatus to provide a straight line for painting.

An additional object of the invention is to provide an ice painting apparatus having an adjustable guide mechanism which pivots about a central point in order to paint circular patterns of various radii, as well as various line widths.

It is again an object of the invention to provide an ice painting apparatus which can be used in a freehand style to paint letters or other insignia on an ice rink.

Yet another object of the invention is to provide an ice painting apparatus capable of laying the necessary lines and insignia in manner which allows significant time savings over previous ice marking methods.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 9 is a side elevational view of a single nozzle spray shield with an attached handle;

FIG. 10 is a perspective view of the ice painting frame configured for straight lines.

Similar reference characters denote corresponding features consistently throughout the attached drawings.

DETAILED DESCRIPTION OF THE PREFERRED EMBODIMENT

Figure 1:
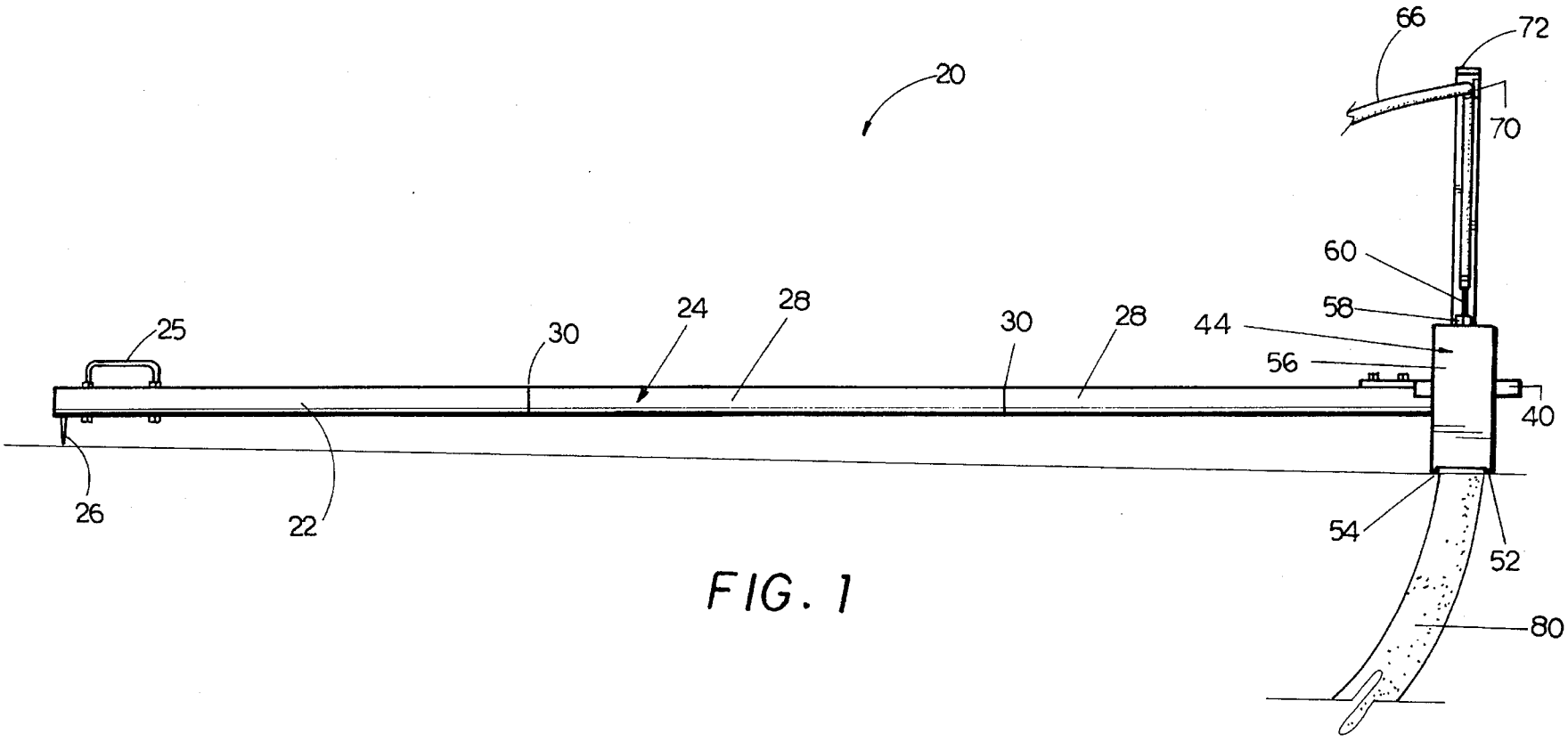
FIG. 1 is an environmental side elevational view of the ice painting apparatus configured for painting circular lines.
Figure 7:
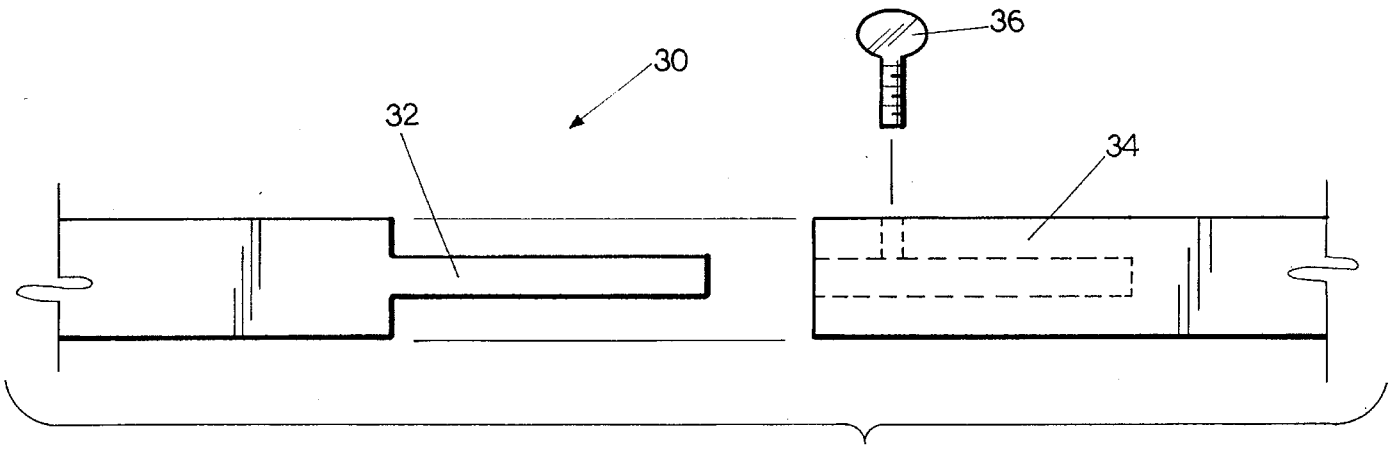
FIG. 7 is an enlarged scale exploded view of a connecting joint.

Turning now to FIG. 1 of the drawings, the circular ice painting system 20 is shown in an assembled position. When it is necessary to paint a circle of a particular radius on the surface of the ice, the first segment 22 of the elongated radius arm 24 is positioned so that the ice engaging pivot point 26 engages the surface of the ice at the center of the desired circle. A handle 25 is provided to maintain the segment 22 in its proper position. Secondary sections 28 are connected to the first segment 22 and to each other via a male-female connection joint 30, as shown in FIG. 7, wherein the male member 32 is inserted into the female member 34 and held in place by a thumb screw 36 or other suitable frictional engaging means.

Figure 8:
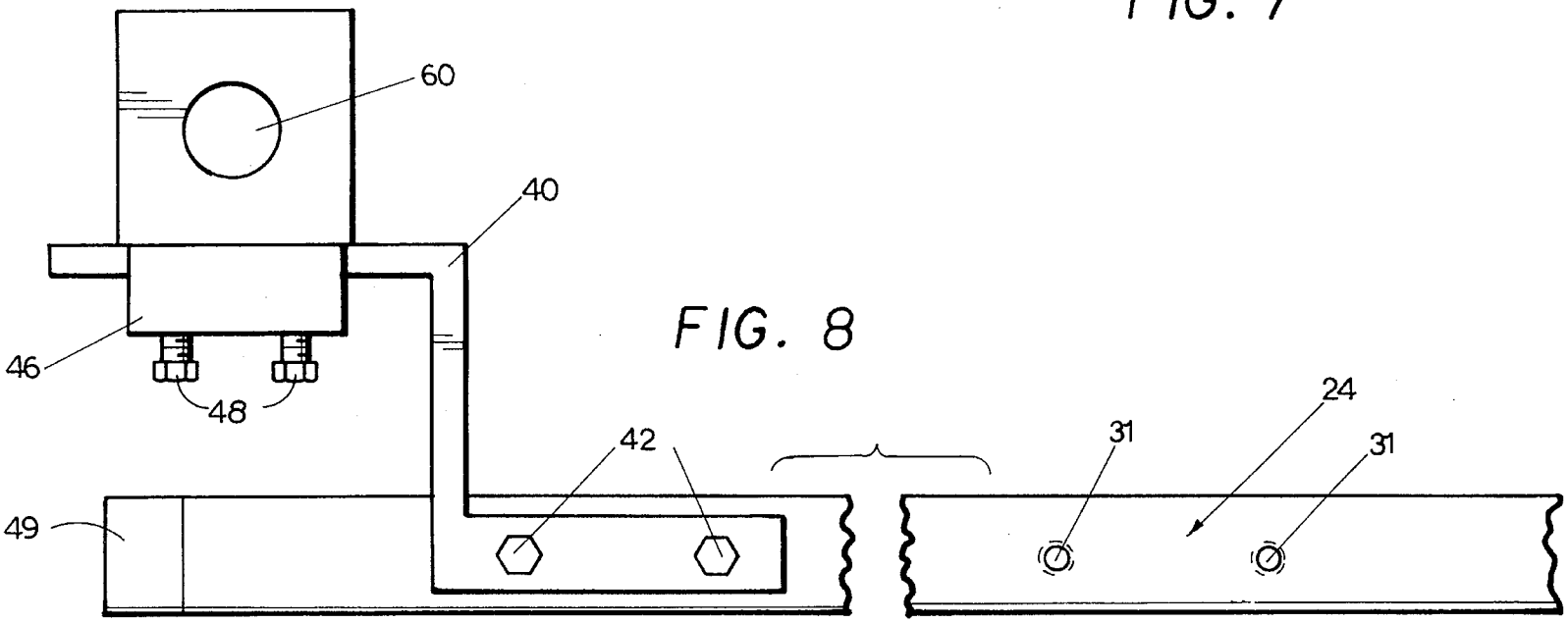
FIG. 8 is a top plan view of a shield attachment means.

As is seen in FIG. 8, the final secondary section 28 has a solid cap 49 to secure the end of the tubular segment. Once the appropriate length is achieved, a "Z" bar 40 is removably attached to the outermost secondary segment 28 (or other predetermined points 31) with threaded bolts 42,42 or other appropriate fasteners. The opposite end of the "Z" bar 40 provides a location to attach the paint spray shield 44. Of course, while the "Z" bar is shown and described, it is not meant to limit the invention to this specific type of coupling.

Figure 5:
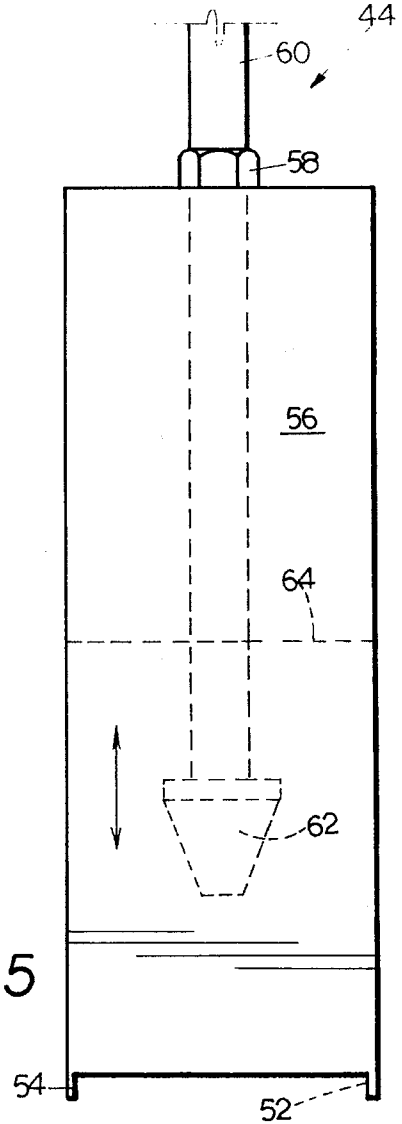
FIG. 5 is a rear elevational view of a single nozzle spray shield.
Figure 4:
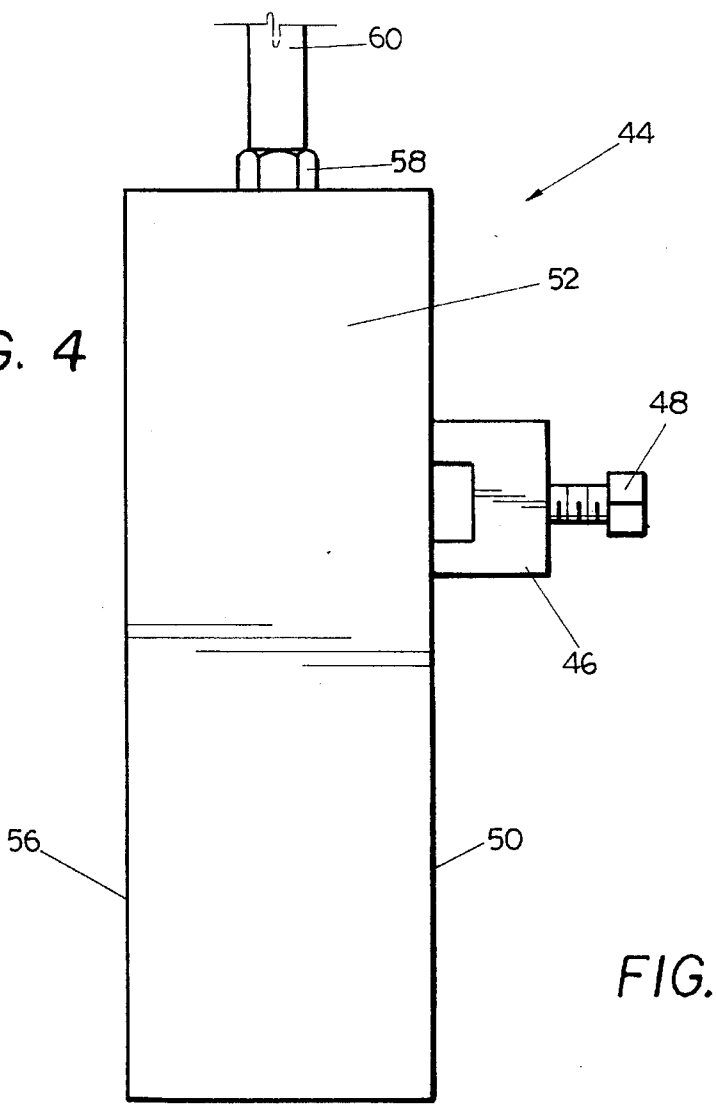
FIG. 4 is a side elevational view of a single nozzle spray shield.
Figure 3:
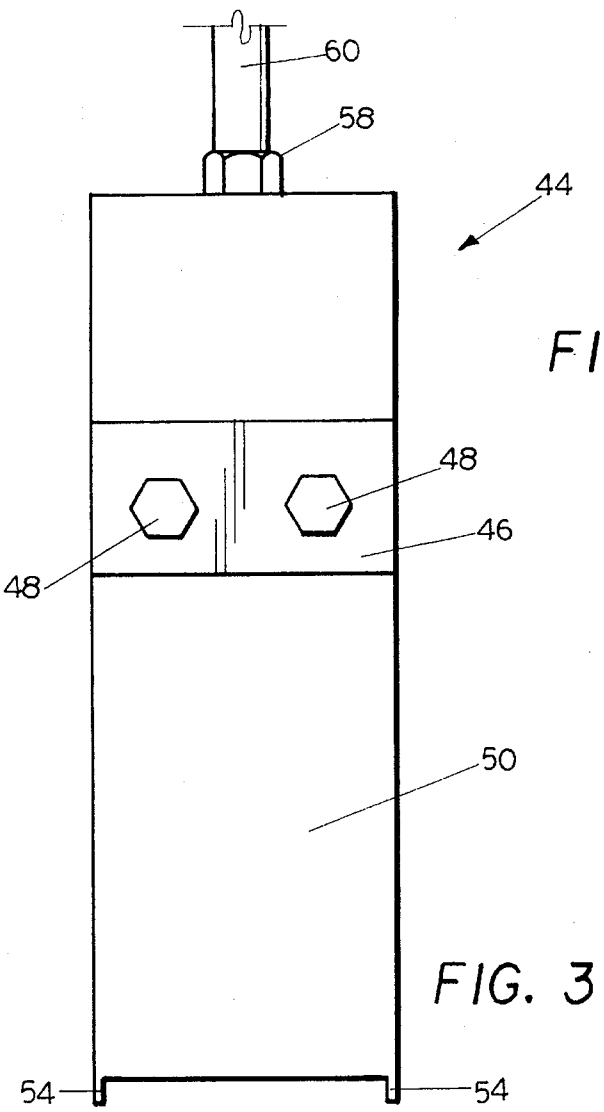
FIG. 3 is a front elevational view of a single nozzle spray shield.

With reference now to FIGS. 3 through 5, the single nozzle paint spray shield 44 is of parallelapiped construction, having a "Z" bar 40 attachment clamp 46, attached to its front wall 50, through which the "Z" bar 40 passes and is held in place with bolts 48 or other suitable fasteners. The inner wall 54 and outer 52 wall of the shield 44 are in contact with the ice, while the front wall 50 and rear wall 56 terminate in bottom edges elevated above the ice. Attached to the top portion of the shield 44 is a compression fitting 58, through which the paint spray nozzle supply tube 60 passes. The fitting 58 allows tube 60 to be adjusted vertically to allow for the proper dispersal pattern of paint. Referring to FIG. 5, attached to the lower end of the tube 60 is a nozzle tip 62. A rigid plate 64 is permanently attached to and within the paint shield 44 to maintain the tube 60 and nozzle 62 in their proper orientations.

Turning to FIGS. 1 and 9, an interconnecting hose 66 is attached via hose clamps 68, 68 to the paint spray nozzle supply tube 60. Paint is dispersed from an appropriate storage and compression system (not shown) through the hose 66 and out the nozzle 62 (shown in FIG. 5) to be applied to the surface of the ice. A flow control mechanism 70 is attached to and within the hose 66 to allow the user to control the flow of paint to the surface of the ice. Securably attached to the paint shield 44 is an L-shaped handle 72 which rises vertically from the shield 44 and angles back over it, allowing the user to grasp handle 72 or the handgrip 74 incorporated into the hose 66 and maneuver the apparatus. The flow control mechanism 70 is in close proximity to both the handle 72 and the handgrip 74 to provide convenient use.

Returning to FIG. 1, the ice painting system 20 requires two people, working together. One person the maintains contact between the surface of the ice and the ice engaging pivot point 26 while the other person maneuvers the paint shield 44 and controls the flow of paint. As the shield 44 pivots about its center point 26, a circular line of paint 80 is applied to the ice. The process is repeated whenever the lines fade or otherwise need to be reapplied.

Figure 2:
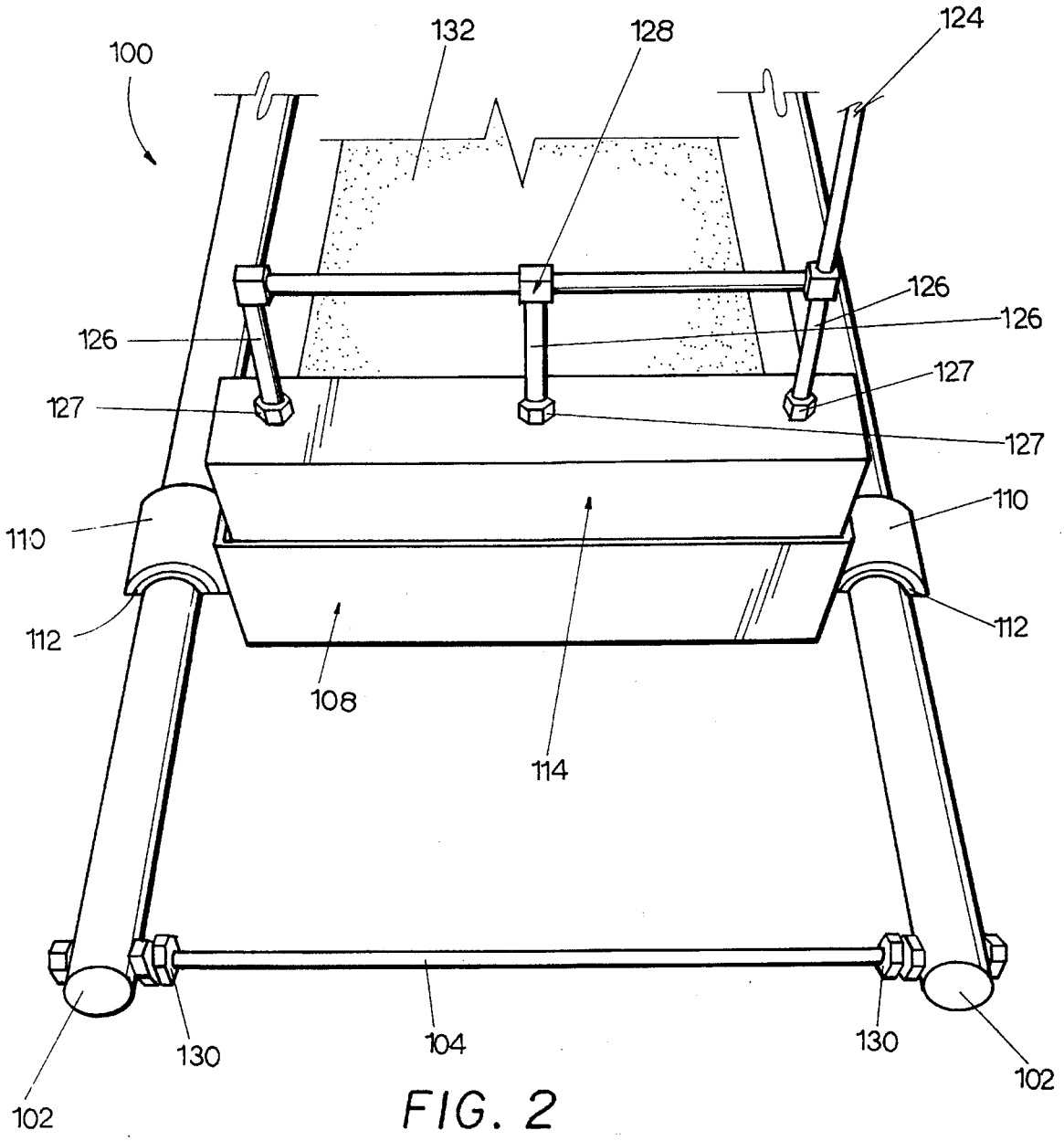
FIG. 2 is an environmental, partial, front perspective view of the ice painting apparatus configured for painting straight lines.
Figure 11:
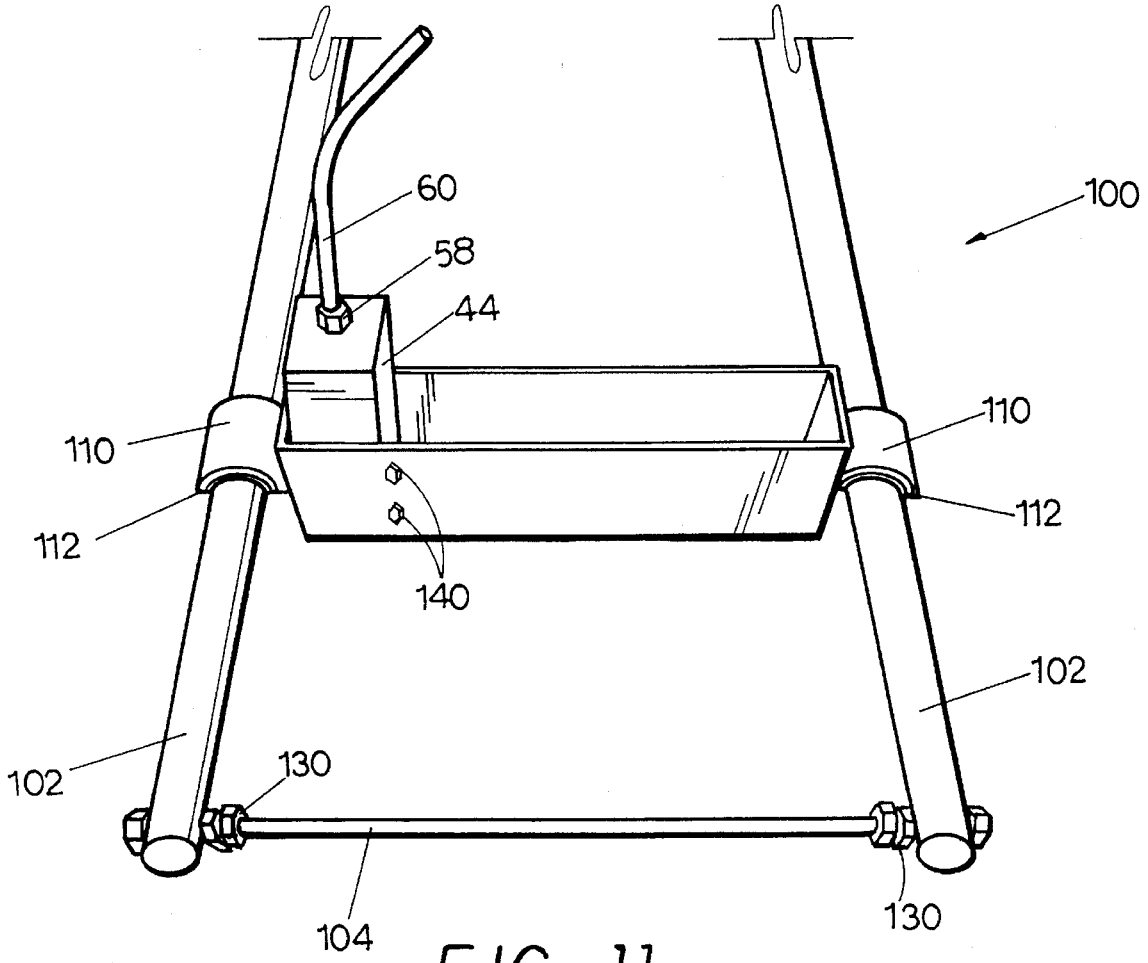
FIG. 11 is a partial front perspective view of the ice painting system configured for straight lines with a single nozzle spray shield.

The straight line ice painting assembly 100, as seen in FIGS. 2, 10 and 11, is composed of two parallel elongated rails 102,102 which are held apart from each other by two connecting rods 104, 104 which intersect the rails 102,102 at each end. Located along the length of the rails 102, 102 are a plurality of ice engaging supports 106 (see FIG. 10) which support the rails 102,102 above the surface of the ice. Fully, constructed, the apparatus so far described forms a rectangular framework which is elevated above the ice. Inside this framework is a rigid, rectangular frame 108. At each end of the frame 108, an arcuate support 110 is attached. Each support 110 has a nylon lining 112 which rests on its guide rails 102,102, allowing the frame 108 to move or glide easily in a straight line over the rails 102, 102.

Figure 6:
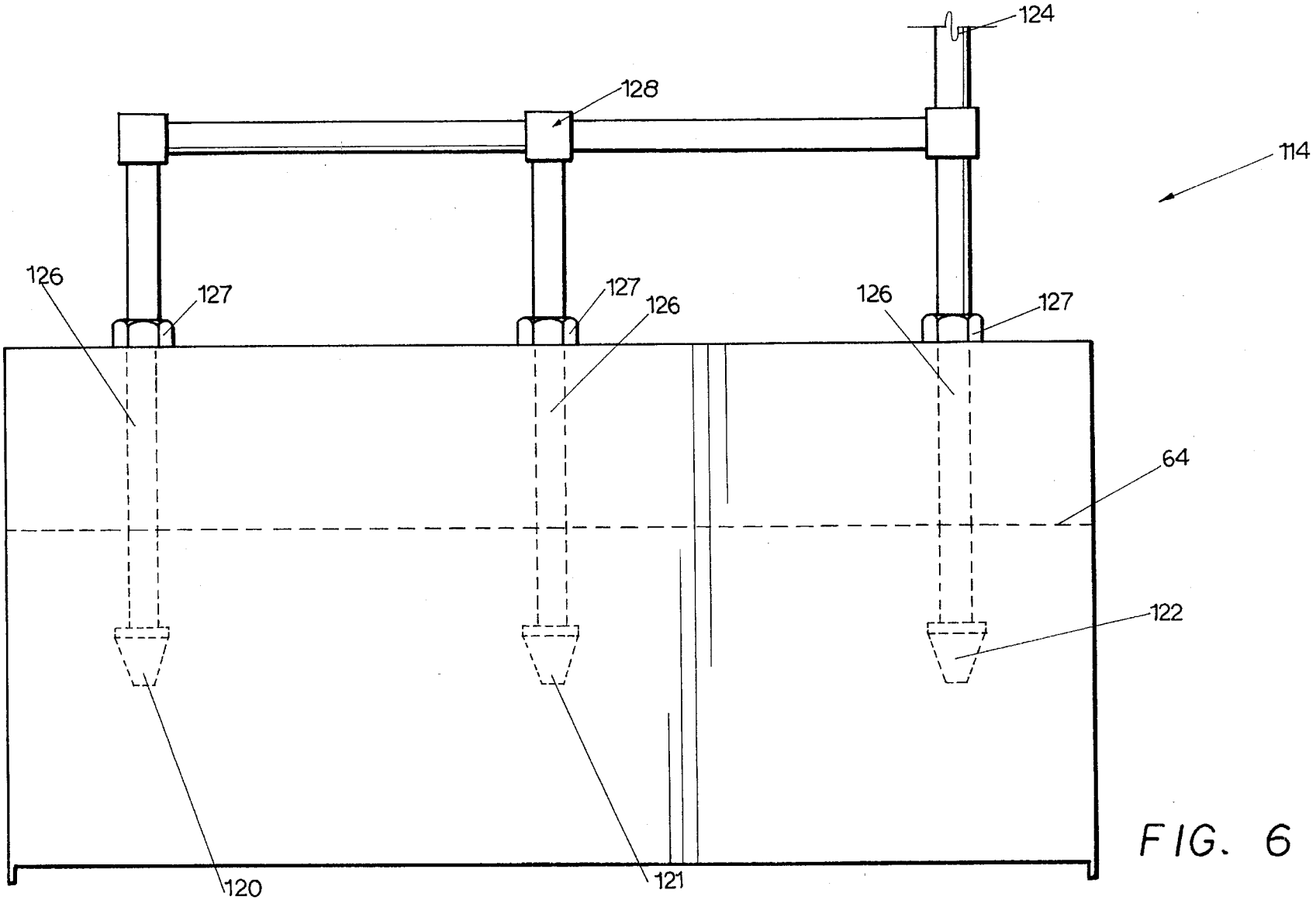
FIG. 6 front elevational view of a multi-nozzle spray shield.

A rectangular multi-nozzle paint spray shield 114 (FIGS. 2 and 6) is seated within the framework 108, but rests atop the surface of the ice. Similar to the single nozzle paint spray shield 44, the multi-nozzle shield 114 engages the ice with only two edges, these being a first edge 116 and second edge 118, allowing the shield 114 to pass over freshly laid paint without contacting it. Spray nozzles 120, 121, 122 are manifolded to a common supply of paint 124 via a network of supply tubes 126 which pass through compression fittings 127 allowing the nozzles 120–122 to be adjusted vertically. The supply tubes 126 are joined together with tees and other appropriate interconnecting fittings 128.

To employ the assembly 100, the rails 102,102 are aligned over the area to be painted. A location marker 130 is attached to each connecting rod 104 in order to locate the inside edge of the paint shield 114 over the exact position of the desired line. The paint shield 114 is placed atop the ice within the framework 108 (as shown in FIG. 2). The appropriate connections are made as described above. The flow of paint is started and the frame 108 is moved along the rails 102,102 producing a painted line 132. If a line to be painted is longer than the apparatus 100, the process is simply repeated after moving the framework 100 to the termination of the previous paint line.

Using the same apparatus 100, narrower lines may be painted. The apparatus is arranged in the same manner as above, except that the single nozzle paint spray shield 44 is placed inside the rectangular frame 108, as is seen in FIG. 11. A pair of bolts 140 or other appropriate fasteners are inserted through holes in the frame 108 and prevent the smaller shield 44 from moving sideways. An intermediate paint spray shield (not shown) is adapted to fit within the space created on the other side of the bolts 140. The size of the paint shields correspond to the standard widths of lines normally painted on an ice rink. To paint lines with widths other than those described, the bolts 140 simply need to be repositioned in a location suitable to the size of the desired paint shield.

The paint shields, particularly the single nozzle paint shield 44, may be used in a freehand mode to paint lettering or other insignia. The desired pattern is etched onto the ice and the paint shield 44 is manually directed over the area to be painted. Straight edge guides may be used when appropriate to lend consistency to the freestyle designs.

It is to be understood that the present invention is not limited to the sole embodiment described above, but encompasses any and all embodiments within the scope of the following claims.

I claim:

1. An apparatus for painting arcs on ice in an ice rink, the apparatus comprising:

a radius arm having a first end and a second end;

an ice engaging pivot depending from said first end of said radius arm;

a rectangular paint spray shield removably attached to said radius arm proximate said second end, said shield having opposite inner and outer walls and opposite front and back walls, said inner and said outer walls both terminating in bottom edges, said front and back walls terminating in bottom edges elevated above said bottom edges of said inner and outer walls;

a paint spray nozzle disposed within said shield; and a paint supply hose connected to said nozzle.

2. The apparatus for painting ice according to claim 1, further comprising a first handle attached to said first end of said radius arm for maintaining contact between said pivot and the ice.

3. The apparatus for painting ice according to claim 1 wherein said radius arm is comprised of multiple sections.

4. The apparatus for painting ice according to claim 1, further including means for attaching said shield at a plurality of locations along said radius arm.

5. The apparatus for painting ice according to claim 1, further comprising a second handle having an upper end and a lower end, said lower end removably attached to said spray shield, and wherein said second handle includes a paint supply control mechanism adjacent said upper end.

6. The apparatus for painting ice according to claim 1, further comprising means for vertically adjusting said nozzle within said shield.

7. The apparatus for painting ice according to claim 1, further comprising a support plate disposed horizontally within said shield, said plate supporting said nozzle within said shield.

8. An apparatus for painting lines on ice in an ice rink, the apparatus comprising:

a first rail having a first end and a second end;

a second rail having a first end and a second end;

a first rod connecting said first end of said first rail with said first end of said second rail;

a second rod connecting said second end of said first rail with said second end of said second rail, said first and said second rods maintaining said first rail parallel to and spaced apart from said second rail;

a frame including a pair of supports extending therefrom, said pair of supports resting atop said first and second rails to allow said frame to ride along said rails;

a rectangular paint spray shield seated within said frame, said shield having opposite inner and outer walls and opposite front and back walls, said inner and outer walls both terminating in bottom edges, said front and back walls terminating in bottom edges elevated above said bottom edges of said inner and outer walls;

a paint spray nozzle means disposed within said shield; and a paint supply hose connected to said nozzle.

9. The apparatus for painting ice according to claim 8, further comprising a handle having an upper end and a lower end, said lower end removably attached to said spray shield, said handle including a paint supply control mechanism adjacent said upper end.

10. The apparatus for painting ice according to claim 8, further comprising a plurality of ice engaging supports depending from said first rail and said second rail for positioning the apparatus on the ice.

11. The apparatus for painting ice according to claim 8, wherein said paint spray nozzle means includes a plurality of interconnected paint spray nozzles.

12. The apparatus for painting ice according to claim 8, further comprising means for vertically adjusting said paint spray nozzle within said shield.

13. The apparatus for painting ice according to claim 8, further comprising support plates disposed horizontally within said shields, said plates supporting said nozzles within said shields.

14. An ice painting system for applying arcs and lines to the ice in a hockey rink, the system comprising:

a paint spray assembly including, a rectangular paint spray shield, said shield having opposite inner and outer walls and opposite front and back walls, said inner and said outer walls both terminating in bottom edges, said front and back walls terminating in bottom edges elevated above said bottom edges of said inner and outer walls, a paint spray nozzle means disposed within said shield, and a paint supply hose connected to said nozzle;

a line painting assembly including, a first rail having a first end and a second end, a second rail having a first end and a second end, a plurality of ice engaging supports depending from said first rail and said second rail for positioning said rails on the ice, a first rod connecting said first end of said first rail with said first end of said second rail, a second rod connecting said second end of said first rail with said second end of said second rail, said first and said second rods maintaining said first rail parallel to and spaced apart from said second rail, a frame for seating said shield such that said bottom edges of said inner and outer walls of said shield lie on the ice parallel to said first and said second rails, a pair of arcuate supports extending from said frame, said pair of arcuate supports resting atop said first and second rails to allow said frame to ride between said first and said second rails from said first rod to said second rod; and an arc painting assembly including, a radius arm having, a first end, and a second end attachable to said shield, and an ice engaging pivot attached to said first end of said radius arm.

15. The ice painting system according to claim 14, wherein said paint spray nozzle menas includes a plurality of interconnected paint spray nozzles.

16. The ice painting system according to claim 14 wherein said radius arm is comprised of multiple sections.

17. The ice painting system according to claim 16 wherein said radius arm includes, means for locating said shield at a plurality of locations along said radius arm.

18. The ice painting system according to claim 14 wherein said paint spray assembly further includes means for vertically adjusting said nozzle means within said shield.

19. The ice painting system according to claim 14 further comprising a first handle attached to said first end of said radius arm for maintaining contact between said pivot and the ice.

20. The ice painting system according to claim 14 further comprising a second handle having an upper end and a lower end, said lower end removably attached to said spray shield, wherein said second handle includes a paint supply control mechanism adjacent said upper end.

* * * * *